US005848451A

United States Patent [19]

Barnett

[11] Patent Number: 5,848,451

[45] Date of Patent: Dec. 15, 1998

[54] FLOOR MOP HEAD HAVING SCRUBBING SURFACE

[75] Inventor: Rickie A. Barnett, Englewood, Tenn.

[73] Assignee: Rubbermaid Commercial Products Inc., Winchester, Va.

[21] Appl. No.: 682,319

[22] Filed: Jul. 17, 1996

[51] Int. Cl.[6] ..... A47L 13/12; A47L 13/20

[52] U.S. Cl. ..... 15/118; 15/229.2; 15/229.11

[58] Field of Search ..... 15/147.1, 228, 15/229.1–229.9, 118, 229.11

[56] References Cited

U.S. PATENT DOCUMENTS

| | | | |
|---|---|---|---|
| 1,683,816 | 9/1928 | Brown | 15/229.6 |
| 1,774,209 | 8/1930 | Nelson | 15/229.6 |
| 2,825,914 | 3/1958 | Moss . | |
| 2,891,270 | 6/1959 | Reiter . | |
| 3,011,198 | 12/1961 | Moss . | |
| 3,115,658 | 12/1963 | Moss . | |
| 3,135,002 | 6/1964 | Moss . | |
| 3,324,497 | 6/1967 | Moss . | |
| 3,336,620 | 8/1967 | Moss . | |
| 3,362,037 | 1/1968 | Griffin . | |
| 3,395,415 | 8/1968 | Leland . | |
| 3,432,873 | 3/1969 | Moss . | |
| 3,501,796 | 3/1970 | Moss . | |
| 3,622,189 | 11/1971 | Rosehitz et al. . | |
| 3,644,958 | 2/1972 | Moss . | |
| 3,689,118 | 9/1972 | Charvat et al. . | |
| 3,696,640 | 10/1972 | Moss . | |
| 3,703,571 | 11/1972 | Roberts . | |
| 3,703,738 | 11/1972 | Moss et al. . | |
| 3,713,184 | 1/1973 | Leland . | |
| 3,760,450 | 9/1973 | Griffin et al. . | |
| 3,761,991 | 10/1973 | Moss . | |
| 3,763,517 | 10/1973 | Moss . | |
| 3,795,934 | 3/1974 | Moss . | |
| 3,805,315 | 4/1974 | Moss . | |
| 3,817,004 | 6/1974 | Moss . | |
| 3,822,517 | 7/1974 | Moss . | |
| 3,843,993 | 10/1974 | Leland . | |
| 3,924,289 | 12/1975 | Richards . | |
| 3,962,743 | 6/1976 | Moss . | |
| 3,966,259 | 6/1976 | Richards . | |
| 3,981,040 | 9/1976 | Crofton . | |
| 3,996,639 | 12/1976 | Griffin et al. . | |
| 4,019,442 | 4/1977 | Lee et al. . | |
| 4,085,476 | 4/1978 | Moss . | |
| 4,130,683 | 12/1978 | Michel et al. . | |
| 4,133,147 | 1/1979 | Swift, Jr. . | |
| 4,264,337 | 4/1981 | Fenster et al. . | |
| 4,288,884 | 9/1981 | Bahls | 15/229.2 |
| 4,306,326 | 12/1981 | Kim . | |
| 4,483,035 | 11/1984 | Moss et al. . | |
| 4,530,130 | 7/1985 | Moss . | |
| 4,672,968 | 6/1987 | Lenox et al. . | |
| 4,675,932 | 6/1987 | Hofacker, Jr. | 15/118 |
| 4,723,325 | 2/1988 | Perry . | |
| 4,750,234 | 6/1988 | Quearry et al. . | |
| 4,758,299 | 7/1988 | Burke . | |
| 4,811,990 | 3/1989 | Quearry et al. . | |
| 4,908,901 | 3/1990 | Torres . | |
| 4,964,186 | 10/1990 | Stuck . | |
| 4,993,099 | 2/1991 | Emura et al. . | |
| 5,013,600 | 5/1991 | Da Re . | |
| 5,227,229 | 7/1993 | McMahan McCoy et al. . | |

*Primary Examiner*—Randall E. Chin
*Attorney, Agent, or Firm*—Renner, Kenner, Greive, Bobak, Taylor & Weber

[57] ABSTRACT

A headband (22) for a mop head assembly (10) includes four scrubbing surfaces (40, 42, 44, and 46) that allow a user to scrub a surface with the headband (22). The scrubbing surfaces (40, 42, 44 and 46) include a plurality of interstices (34) and scrubbing sections (36) that are formed by coating a knitted polyester base material (30) with an adhesive and abrasive coating (32). The coating (32) provides strength, durability, and abrasiveness to the base material (30). In addition to the ability to scrub, the headband (22) allows the yarn (20) beneath the headband (22) to dry thus preventing mildew.

7 Claims, 2 Drawing Sheets

FLOOR MOP HEAD HAVING SCRUBBING SURFACE

TECHNICAL FIELD

The present invention relates to mop heads and, more particularly, to a mop head assembly having a scrubbing surface. Specifically, the present invention relates to a mop head assembly having a headband with a scrubbing surface integrally formed thereon.

BACKGROUND ART

A typical industrial floor mop includes a handle connected to a handle head. A connector incorporated in the handle head functions to selectively connect a mop head assembly to the mop handle. A mop head assembly generally includes a plurality of yarn strands that are bound by a headband. In some mop head assemblies, the ends of the yarn strands are further bound by tail bands.

A floor mop as described above is typically used in commercial or industrial cleaning operations. As such, the mop head assemblies are subject to heavy and often continuous use. Once full of dirt and no longer particularly effective for cleaning, the mop head assemblies are detached from the handle heads and are laundered. The head assemblies are then dried before the next use. In the mop head assemblies of the prior art, the headband prevented the yarn underneath the headband from quickly drying after laundering. The wet yarn beneath the headband would then mildew and more rapidly deteriorate than the other yarn. Prior art headbands also would crack, fray, or peel after repeated laundering.

The users of the floor mops also typically encounter areas on floors that require scrubbing. Instead of putting the mop aside and scrubbing the area with a separate scrubber, the user often attempts to scrub the floor area with the headband of the mop head assembly. Such scrubbing action is not only inefficient but also may tear the headband and may contribute to the rapid deterioration of the headband and mop yarns. Another factor that leads to the deterioration of headbands is the effects of the chemical cleansers on the headband material.

DISCLOSURE OF THE INVENTION

It is, therefore, a primary object of the present invention to provide a mop head assembly for a floor mop that incorporates a scrubbing surface into the headband of the assembly.

It is another object of the present invention to provide a mop head assembly, as above, that allows the yarn beneath the headband to dry quickly thus preventing mildew.

It is a further object of the present invention to provide a mop head assembly, as above, that includes a headband that is resistant to the deteriorative effects of chemical cleaning agents.

It is yet another object of the present invention to provide a mop head assembly, as above, that may be used with existing handle heads without requiring modification of the handle head assemblies.

It is still a further object of the present invention to provide a mop head assembly, as above, that incorporates a scrubbing surface that inhibits the scratching of flooring materials.

It is yet a further object of the present invention to provide a mop head assembly, as above, that is resistant to the deteriorative effects of frequent laundering.

It is another object of the present invention to provide a mop head assembly, as above, that incorporates a headband that can be attached to mop yarns utilizing conventional sewing equipment.

These and other objects of the invention, as well as the advantages thereof over existing and prior art forms, which will be apparent in view of the following detailed specification, are accomplished by the improvements hereinafter described and claimed.

In general, a mop head assembly embodying the concepts of the present invention includes a mop head assembly having a plurality of yarn strands, a headband binding the plurality of yarn strands, and a scrubbing surface integrally formed on the headband.

To acquaint persons skilled in the arts most closely related to the present invention, one preferred embodiment of a mop head assembly having a scrubbing surface that illustrates a best mode now contemplated for putting the invention into practice is described herein by, and with reference to, the annexed drawings that form a part of the specification. The exemplary mop head assembly is described in detail without attempting to show all of the various forms and modifications in which the invention might be embodied. As such, the embodiment shown and described herein is illustrative, and as will become apparent to those skilled in these arts, can be modified in numerous ways within the spirit and scope of the invention; the invention being measured by the appended claims and not by the details of the specification.

PREFERRED EMBODIMENT FOR CARRYING OUT THE INVENTION

Figure 1:
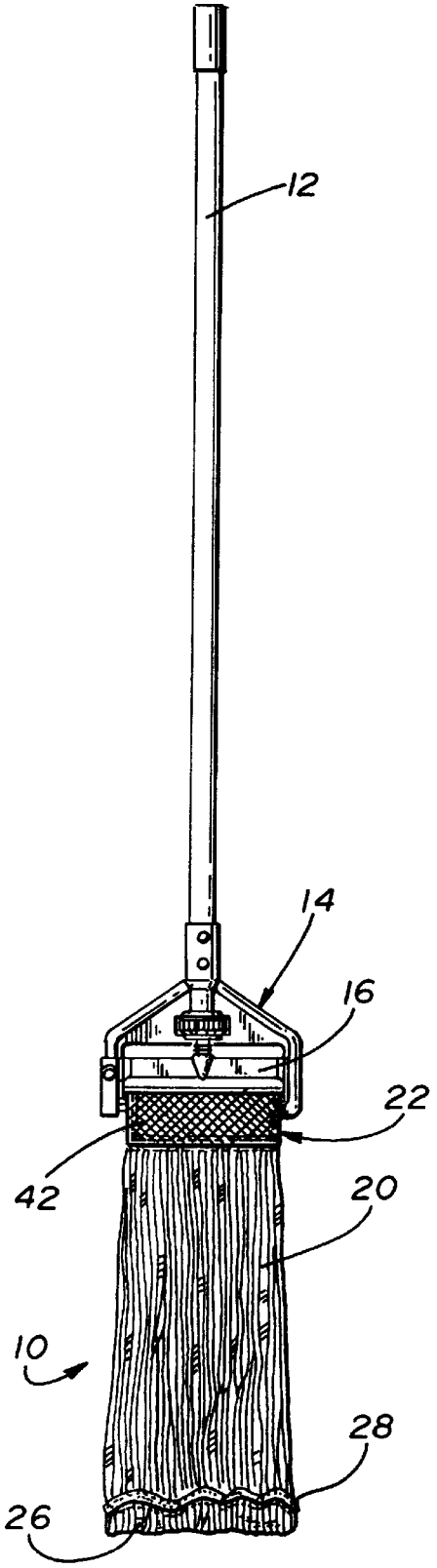
FIG. 1 is an elevational view of a floor mop having a mop head assembly made in accordance with the concepts of present invention.

A mop head assembly according to the present invention is generally indicated by the numeral 10 in the accompanying drawings. In FIG. 1, mop head assembly 10 is depicted as being connected to a mop handle 12 by a handle head 14. In the embodiment of the handle head 14 depicted in the drawings, a clamping mechanism 16 is used to attach the mop head assembly 10 to the handle head 14. Handle heads having other mechanisms for attaching mop head assemblies 10 are known in the art and may also function with the mop head assembly 10 of the present invention.

Figure 2:
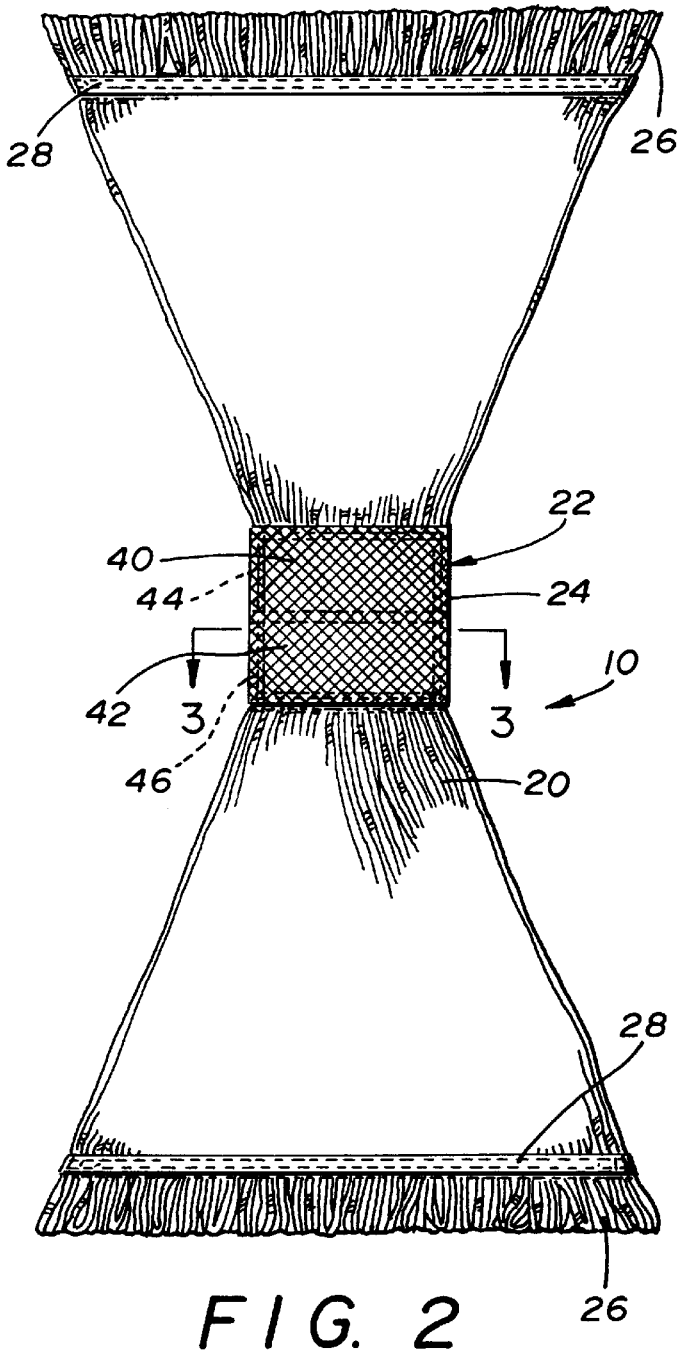
FIG. 2 is a plan view of a detached mop head assembly made in accordance with the concepts of the present invention.
Figure 3:
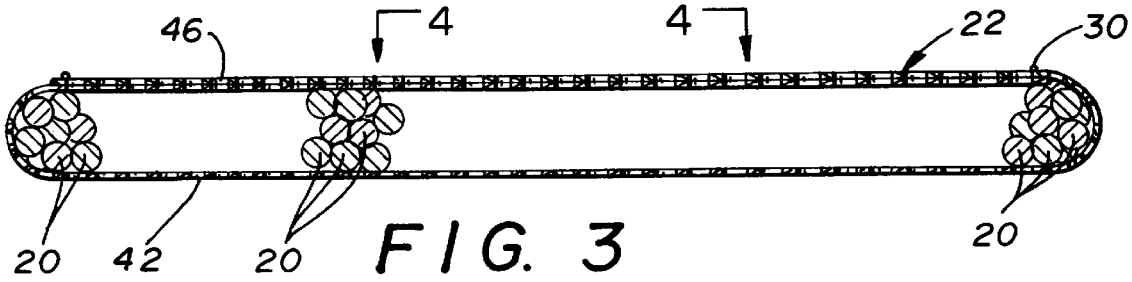
FIG. 3 is an enlarged sectional view taken substantially along line 3—3 in FIG. 2.

Mop head assembly 10 is shown in FIG. 2 detached from handle head 14 and includes a plurality of yarn strands 20 that are commonly bound by a headband generally indicated by the numeral 22. Headband 22 binds yarn strands 20 by being wrapped around the plurality of yarn strands 20 and connected to yarn strands 20 by a polyester thread 24 that is stitched through headband 22 and yarn strands 20. It is noted that either a single length of yarn or numerous lengths of yarn may be used to form the plurality of yarn strands 20 that are bound by headband 22.

Yarn strands 20 are further bound at each end 26 thereof by a tail band 28. Tail bands 28 keep yarn strands 20 spaced from each other while mopping and during laundering to increase the effectiveness of the mop when cleaning and allowing all of yarn strands 20 to be cleaned during laundering.

Headband 22 is formed from a length of open weave or open knit base material 30 that serves as a substrate for a heat curable adhesive, and abrasive coating 32. Base material 30 may be fabricated from a polyester, nylon, or equivalent material. A suitable base material 30 has been found to be Item No. 200 MS 60 NAT from Jason Mills of 220 Kinderkamack Road, Westwood, N.J. 07675-3601. Base material 30 provides the structure for binding yarn strands 20 while coating 32 provides an abrasive quality to base material 30 and increases the durability of headband 22.

Figure 4:
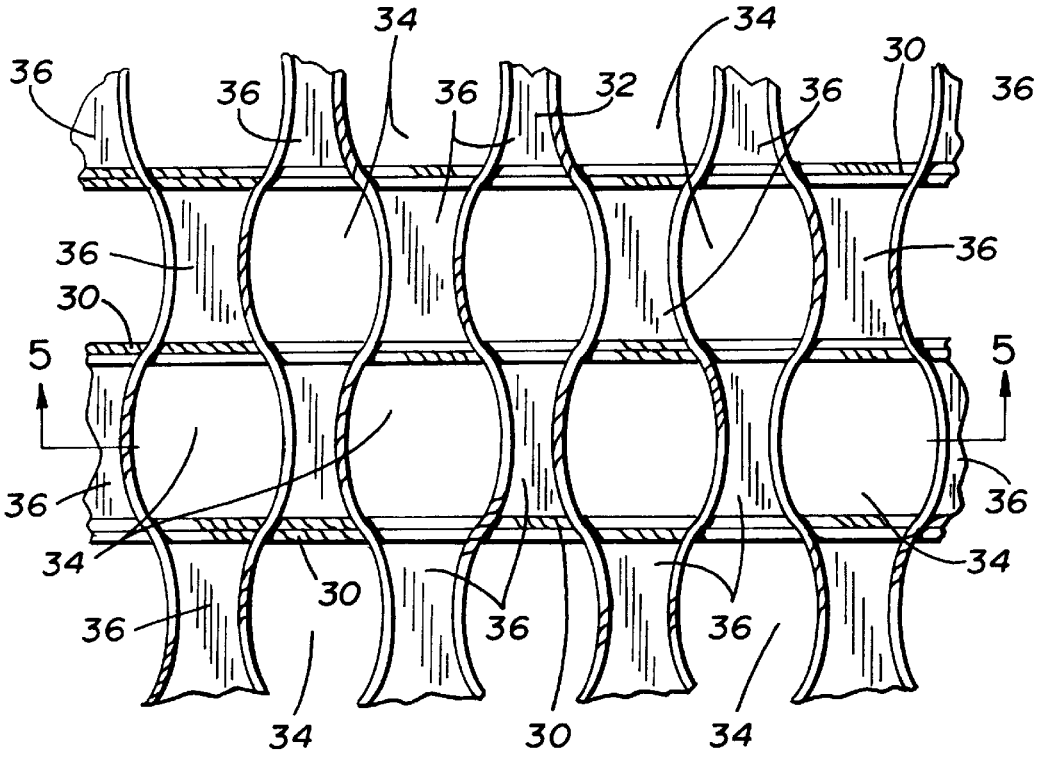
FIG. 4 is an enlarged view taken substantially along line 4—4 of FIG. 3.
Figure 5:
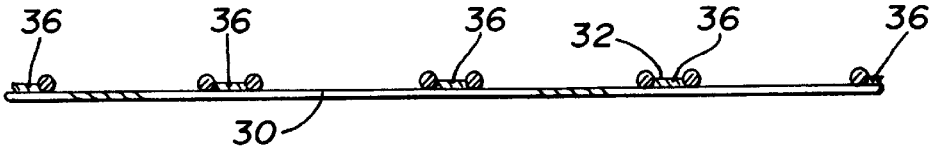
FIG. 5 is a sectional view taken substantially along line 5—5 in FIG. 4.

As may be seen in FIG. 4, base material 30 has a plurality of interstices 34 that expose yarn strands 20 beneath headband 22 to air thus allowing them to dry after wetting. In addition to interstices 34, a plurality of scrubbing sections 36 are formed when base material 30 is coated. The process of coating base material 30 with the adhesive, abrasive material 32 creates the scrubbing sections 36 while allowing interstices 34 to remain open allowing air to contact yarn strands 20 under headband 22. Thus headband 22 is able to prevent the deteriorative effects of mildew on yarn strands 20 beneath headband 22 while providing a plurality of scrubbing sections 36. Headband 22 is also strong enough to resist cracking, fraying, or peeling in response to the laundering process. Furthermore, coating 32 provides an abrasive quality to headband 22 that allows a user to scrub a surface with headband 22 by applying force to handle 12 of the mop.

As such, the mop has four scrubbing surfaces 40, 42, 44 and 46 on headband 22 when attached to handle 12 by handle head 14. Two upper scrubbing surfaces 40 and 42 and two lower scrubbing surfaces 44 and 46 are disposed on either side of handle head 14. The location of scrubbing surfaces 40, 42, 44 and 46 allows a user to scrub a surface with the mop without having to position the mop specifically for scrubbing.

A coating 32 that has been found to be particularly effective for use in conjunction with base material 30 to form headband 22 is disclosed in U.S. Pat. No. 4,264,337 which is incorporated herein by reference for whatever details may be necessary to understand the preferred embodiment of the present invention. A coating suitable for use with the present invention may be obtained from Mercury Foam Corp. of 80 Leuning Street, South Hackensack, N. J. 07606-1395. In general, U.S. Pat. No. 4,264,337 teaches a process for forming a rigidified or strengthened scrubbing portion on a piece of foam. The foam is first impregnated with a liquid, polyurethane adhesive composition that is adapted to harden during curing. The abrasive properties are created by the curing of the composition and may be enhanced by adding a finely comminuted conventional abrasive material. Such has been found herein to be useful not only with the foam product described in the patent, but also for coating the base material 30 to provide the scrubbing surfaces 40, 42, 44 and 46 previously described.

While only a preferred embodiment of the present invention is disclosed, it is to be clearly understood that it is susceptible to numerous changes apparent to one skilled in the art. Therefore, the scope of the present invention is not to be limited to the details shown and described but is intended to include all changes and modifications which come within the scope of the appended claims.

I claim:

1. A mop head assembly comprising a plurality of yarn strands, a headband binding said plurality of yarn strands, said headband including a polyester base material, and at least one scrubbing surface integrally formed on said headband, said scrubbing surface including a plurality of scrubbing sections that are formed by an adhesive, abrasive coating on said base material wherein the adhesive coating imparts abrasive properties when dried.

2. A mop head assembly according to claim 1, wherein said headband has a plurality of interstices.

3. A mop head assembly according to claim 2, wherein said coating is a cured polyurethane adhesive composition adapted to harden during curing.

4. A mop head assembly according to claim 3, further comprising a supplemental abrasive material added to said adhesive, abrasive coating to enhance the scrubbing characteristics of said adhesive, abrasive coating.

5. A mop head assembly according to claim 4, wherein said supplemental abrasive material is prepared from a rigid, foamed polyurethane.

6. A headband for a floor mop, comprising a knitted polyester base material having a plurality of interstices and an adhesive, abrasive coating on said base material to form a plurality of scrubbing sections adjacent to said interstices wherein the adhesive coating imparts abrasive properties when dried.

7. A headband according to claim 6, further comprising a supplemental abrasive material added to said adhesive, abrasive coating to enhance the scrubbing characteristics of said adhesive, abrasive coating.

* * * * *